US009480316B2

(12) United States Patent
Kogelnik

(10) Patent No.: US 9,480,316 B2
(45) Date of Patent: Nov. 1, 2016

(54) PIECE OF LUGGAGE, IN PARTICULAR SUITCASE

(71) Applicant: Voy Gear GmbH, Wiener Neustadt (AT)

(72) Inventor: Michael Kogelnik, Vienna (AT)

(73) Assignee: Voy Gear GmbH, Wiener Neustadt (AT)

( * ) Notice: Subject to any disclaimer, the term of this patent is extended or adjusted under 35 U.S.C. 154(b) by 27 days.

(21) Appl. No.: 13/854,344

(22) Filed: Apr. 1, 2013

(65) Prior Publication Data

US 2013/0264162 A1 Oct. 10, 2013

(30) Foreign Application Priority Data

Apr. 4, 2012 (AT) ..... A 50123/2012
Oct. 16, 2012 (AT) ..... A 50450/2012

(51) Int. Cl.

*A45C 13/02* (2006.01)
*A45C 5/03* (2006.01)
*A45C 13/03* (2006.01)
(Continued)

(52) U.S. Cl.

CPC . *A45C 5/03* (2013.01); *A45C 5/14* (2013.01); *A45C 7/0027* (2013.01); *A45C 13/03* (2013.01); *A45C 13/04* (2013.01); *A45C 2005/037* (2013.01)

(58) Field of Classification Search

CPC .... A45C 13/02; A45C 13/026; A45C 13/03; A45C 2007/0004; A45C 7/0045; A45C 7/0027; A45C 13/04
USPC ..... 190/108.901, 110, 13 R, 18 R, 102; 150/111; 206/278, 298, 287
See application file for complete search history.

(56) References Cited

U.S. PATENT DOCUMENTS 303,099 A * 8/1884 Hawley et al. ..... F16C 33/201 384/416
787,836 A * 4/1905 Davis ..... A45C 5/04 190/13 H (Continued)

FOREIGN PATENT DOCUMENTS

DE 298 07 402 9/1998
FR 2 747 023 A1 10/1997
JP 09-173123 7/1997

OTHER PUBLICATIONS

Austrian Office Action in A 50123/2012, dated Jan. 29, 2013, with English translation of relevant parts.

(Continued)

*Primary Examiner* — Sue A Weaver
(74) *Attorney, Agent, or Firm* — Collard & Roe, P.C.

(57) ABSTRACT

The invention relates to a piece of luggage (1), in particular a suitcase, comprising a shell (2) of at least partially rigid material and side elements (3, 4), wherein the shell (2) of the piece of luggage (1) is embodied so as be capable of being unfolded or unrolled and is provided on the inner side with holding elements (5), which are equipped to hold at least one piece of clothing (6). In order to store a piece of clothing (6) in a preferably crease-proof manner, the shell (2) is arranged at a defined distance (d) around a core (7) in the closed state of the piece of luggage (1), wherein the at least one piece of clothing (6) is stored in a substantially crease-free and pressure-free manner within the space (8), which is formed by means of the defined distance (d) between core (7) and shell (2).

13 Claims, 8 Drawing Sheets

(51) Int. Cl.

| | |
|---|---|
| ***A45C 13/04*** | (2006.01) |
| ***A45C 5/14*** | (2006.01) |
| ***A45C 7/00*** | (2006.01) |

(56) References Cited

U.S. PATENT DOCUMENTS

| | | | | | |
|---|---|---|---|---|---|
| 838,621 | A | * | 12/1906 | Demartini | A45C 5/04 190/13 C |
| 1,150,057 | A | | 8/1915 | O'Neill | |
| 1,666,536 | A | * | 4/1928 | Kvare | 206/298 |
| 1,796,961 | A | * | 3/1931 | Ritter, Jr. | 206/292 |
| 1,823,403 | A | * | 9/1931 | Krueger | 190/124 |
| 2,296,080 | A | * | 9/1942 | Arrowood | 206/298 |
| 2,362,807 | A | | 11/1944 | Dresner | |
| 2,453,663 | A | * | 11/1948 | Hinson | A45C 3/004 190/100 |
| 2,997,167 | A | * | 8/1961 | Westfall, Jr. | 206/287 |
| 3,128,854 | A | * | 4/1964 | Specht | A45C 3/00 190/903 |
| 3,448,839 | A | * | 6/1969 | Lugash | A45C 13/03 190/111 |
| 3,552,529 | A | * | 1/1971 | Marshall | A47B 61/06 190/107 |
| 4,170,282 | A | * | 10/1979 | Schwartzstein | 206/287.1 |
| 4,206,835 | A | * | 6/1980 | Shapiro | 190/108 |
| 4,436,189 | A | * | 3/1984 | Baum | 190/108 |
| 4,598,803 | A | * | 7/1986 | Ghiassi | 190/108 |
| 4,693,344 | A | * | 9/1987 | Shuler | A45C 3/00 190/107 |
| 4,998,603 | A | * | 3/1991 | Nordstrom | A45C 3/004 190/108 |
| 5,398,807 | A | * | 3/1995 | Plath | 206/298 |
| 5,624,026 | A | * | 4/1997 | Chernoff | 206/289 |
| 6,276,501 | B1 | | 8/2001 | Tong | |
| 7,416,066 | B2 | * | 8/2008 | Chernoff | 190/108 |
| D601,796 | S | * | 10/2009 | Banks | D3/279 |
| 2004/0007433 | A1 | | 1/2004 | Godshaw et al. | |
| 2007/0012695 | A1 | * | 1/2007 | Yang | A45C 5/02 220/8 |
| 2008/0283350 | A1 | | 11/2008 | Vorderkunz | |
| 2013/0233660 | A1 | * | 9/2013 | Bettua | A45C 5/03 190/9 |

OTHER PUBLICATIONS

Austrian Office Action in A 50450/2012, dated Feb. 14, 2013, with English translation of relevant parts.

European Search Report dated Jun. 28, 2013 in European Application No. 13 15 9936.7 with English translation of the relevant parts.

Office Action reference No. B135457 mailed Jul. 1, 2014 in Japanese patent application 2013-077448.

Office Action dated May 22, 2014 in Chinese patent application No. 201210468065.X.

* cited by examiner

PIECE OF LUGGAGE, IN PARTICULAR SUITCASE

CROSS REFERENCE TO RELATED APPLICATIONS

Applicant claims priority under 35 U.S.C. §119 of Austrian Application No. A 50123/2012 filed Apr. 4, 2012 and Austrian Application No. A 50450/2012 filed Oct. 16, 2012, the disclosures of which are incorporated by reference.

BACKGROUND OF THE INVENTION

1. Field of the Invention

The invention relates to a piece of luggage, in particular to a suitcase, comprising a shell of at least partially rigid material and side elements, wherein the shell is embodied so as to be capable of being unfolded or unrolled and is provided on the inner side with holding elements which are equipped to hold at least one piece of clothing. The term piece of luggage does not only include suitcases or trolleys, but also travelling bags and the like.

2. Description of the Related Art

In the case of common pieces of luggage, it is problematic for the most part to stow pieces of clothing in a crease or wrinkle-free manner. Wrinkles in pieces of clothing are generally produced by the cooperation of two factors, namely a narrow radius about which the piece of clothing is laid and/or folded, as well as pressure exerted on the piece of clothing. In pieces of luggage comprising only one storage compartment, the pieces of clothing are subjected to the pressure of objects arranged on top thereof and in the case of embodiments of the piece of luggage of flexible material, they are furthermore subjected to forces, which are introduced from the outside. Pieces of clothing, in particular dresses, suits, shirts and blouses of fabrics, which crease easily and which are sensitive, must thus be ironed or smoothed in a different way after unpacking from the piece of luggage. This can be remedied in parts, in that the pieces of luggage are embodied with a plurality of storage compartment, so that the pieces of clothing are not pressed by the remaining objects. Improvements, in particular for the transport of suits, can also be reached with the use of garment bags. The transport of such garment bags, however, is uncomfortable and they are furthermore not equipped with wheels, which would allow for the piece of luggage to be pulled. In the event that the pieces of luggage are formed of a more rigid material, an application of force from the outside is substantially eliminated. The disadvantage thereby, however, is the higher weight of the piece of luggage resulting therefrom.

For a long time, there has thus been a demand for pieces of luggage, which provide for or which at least largely support a storing and/or transporting of pieces of clothing, which is as comfortable as possible, but still crease-free.

For example, U.S. Pat. No. 7,416,066 B2 describes a trolley, in the case of which a garment bag comprising the piece of clothing, which is to be protected, is wound around and fastened to the outside of the body of the trolley. It is disadvantageous thereby that the piece of clothing in the garment bag, which is made of necessarily soft material, is subjected to compressive forces, which lead to a creasing of the piece of clothing. The winding of the garment bag around the body of the trolley is also an extensive process, in the case of which the loaded suitcase is rolled across the soft suit and can thereby crease it easily. A bad connection of the garment bag to the outside of the trolley can furthermore lead to a slipping of the garment bag. The soft molding of the garment bag does not allow attaching wheels thereto, whereby they must be attached to the lower, more rigid surface of the trolley. The overall height of the trolley is increased considerably through this and, at best, the hand luggage size, which is maximally admissible in air travel, is exceeded. Finally, the outer dimensions of the piece of luggage can also be exceeded by correspondingly loading the garment bag and the piece of luggage can no longer be accepted as hand luggage in air travel, for example. It goes without saying that a higher weight of the piece of luggage also results from the fact that the body of the trolley as well as the garment bag are quasi embodied as independent pieces of luggage.

DE 298 07 402 U1 describes a pilot suitcase, in which an oval tube is arranged and the outer walls of which can be folded down, so that a piece of clothing can be arranged around the tube in a crease-free manner. The arrangement of a suit, for example, in this piece of luggage, however, is relatively extensive and complicated, because trousers and suit must be slid individually underneath the tube. The suitcase also does not have rollers, whereby the handling thereof is made more difficult.

U.S. Pat. No. 2,362,807 A describes a suitcase of the generic kind, comprising a smaller inner suitcase, wherein it is possible to store pieces of clothing in a more gentle manner between the outer suitcase and the inner suitcase. The weight of the inner suitcase is at least partially borne by the piece of clothing and changes its position and hence its pressure on the pieces of clothing depending on the handling and the position of the suitcase. Hence, it is not possible to reliably prevent creasing of the pieces of clothing. Moreover, the design as two separate suitcases yields almost double weight of the overall construction as compared to conventional suitcases. Furthermore, it is cumbersome to place the piece of clothing in the suitcase through one opening flap only, so that the piece of clothing has to be turned up and folded in some places, in particular if the dimensions of the suitcase are not to exceed the internationally applicable hand luggage provisions.

SUMMARY OF THE INVENTION

The object according to the invention thus lies in the creation of an above-mentioned piece of luggage, which allows for a substantially crease-free and pressure-free storing and/or transport of pieces of clothing. The loading and unloading of the piece of luggage is to be capable of being carried out as quickly as possible, intuitively and thus easily. The piece of luggage is to be capable of being produced as simply and cost-efficiently as possible and is to encompass a weight, which is as low as possible.

The object according to the invention is solved by means of an above-mentioned piece of luggage, in particular a suitcase, in the case of which the shell is arranged at a defined distance around a core in the closed state of the piece of luggage, wherein the at least one piece of clothing is stored in a substantially crease-free and pressure-free manner within the space, which is formed by the defined distance between core and shell. The piece of luggage substantially consists of a core and of a shell, which can be unfolded or unrolled, between which a space is formed, in which the pieces of clothing can be transported securely, without pressure and in a substantially crease-free manner. Due to the fact that the shell is embodied so as to be capable of being unfolded or unrolled, the insertion of the pieces of clothing onto the inner side of the shell can be carried out in a particularly simple and quick manner. Contrary to known solutions, the piece of clothing is not wound around an inner body, but clings to the inner side of a protective shell of at least partially rigid material and is held there by means of corresponding holding elements. Substantially no pressure or only a slight pressure is exerted on the pieces of clothing in the space between shell and core with the defined distance. The pieces of clothing are thus protected against a creasing in a substantially improved manner. Like currently known pieces of luggage, the piece of luggage at hand can additionally be embodied differently and can be produced in a relatively cost-efficient manner. The shell can be formed of relatively rigid material or can consist of soft, for example textile material and can encompass corresponding reinforcing elements, which reinforce the soft, for example textile material accordingly. Such reinforcing elements can also extend across the entire shell to a large extent.

In the closed state, the ends of the shell of the piece of luggage, which touch one another, are connected to one another, preferably so as to be capable of being locked. The connection can be realized differently, for example by means of a zipper, hook-and-loop fastener, buckles, magnets or the like. Typical locks and the like, which are known in the case of suitcases, can be used for locking.

According to an alternative of the invention, the shell and or the core, respectively, are formed of elements of substantially rigid material, which are connected to one another in an articulated manner. Such a piece of luggage can be embodied in the form of a hard-shell case, wherein the elements of rigid material are connected to one another in an articulated manner.

As an alternative thereto, the shell and or the core, respectively, can also be formed of flexible material comprising reinforcing elements. The reinforcing elements can be arranged in longitudinal direction, transverse direction or also diagonally on the sides of the shell of the piece of luggage and on particularly sensitive locations, such as the corners and edges, for example. Combinations of the above-described elements of substantially rigid material and of flexible material comprising reinforcing elements are possible. The reinforcing elements can consist of different materials, for example plastic, light metal, but also of harder foams. The reinforcing elements increase the stiffness of the shell, which consists of flexible material, in that a material is chosen for the reinforcing elements, which is embodied so as to be stiffer than the flexible material of the shell.

In the closed state of the piece of luggage, the side elements are preferably connected to the shell and or to the core, respectively. Through this, a corresponding stability is also provided to the piece of luggage in the closed state.

According to a further feature of the invention, the side elements are connected to at least one connecting piece and, at best, connecting pieces are connected among one another via hinge-like elements, in particular integral hinges. A cost-efficient piece of luggage can be realized in this manner, because a majority of the components can be produced in an injection molding process.

To stabilize the shell accordingly, the reinforcing elements are connected among one another and or the reinforcing elements and the connecting pieces, respectively, are preferably connected permanently. The connections must thereby be arranged in a correspondingly intelligent manner, so as to obtain a rigid, supporting frame for the piece of luggage.

To establish this connection between the side elements and the shell and or the core, respectively, in the closed state of the piece of luggage, the shell and or the core, respectively, and or the side elements, respectively, encompass corresponding connecting pieces for connecting the shell and or the core, respectively, to the side elements. These connecting pieces can be embodied differently and should be capable of being released as intuitively as possible, in a simple manner and without tools and should hold the piece of luggage in the closed state as securely as possible.

When on the core of the piece of luggage fixing elements and on the side elements corresponding counter pieces to the fixing elements are provided, the core can be held in the desired position with reference to the side elements of the piece of luggage, and the distance between core and shell of the piece of luggage for the substantially crease-free and pressure-free storing of the at least one piece of clothing can be maintained. Different constructions of fasteners, magnets or the like are possible as fixing elements and as counter pieces to the fixing elements.

At least one side element can be fixedly connected to the shell and or to the core, respectively, or can be produced in one piece with the shell and or the core, respectively. By means of such a construction, the production costs can be lowered. For example, the shell can be produced in one piece together with the side elements of textile material and can comprise corresponding reinforcing elements of stiffer material than the textile material of the shell. Such reinforcing elements can also extend across the entire shell to a large extent.

When at least one side element encompasses a closable opening, which leads into the interior of the core, the storage space formed in the interior of the core can be loaded and unloaded easily, without having to open the piece of luggage by unfolding or unrolling the shell. Compartments for dividing the space, which is to be loaded, can also be arranged in the interior of the core.

To ensure the distance between the core and the shell, which considerably reduces or at least limits the pressure exerted on the piece of clothing, the core and or the shell, respectively, and or the side elements, respectively, encompass suitable distance holders. These distance holders can be connected to the shell, the core or the side elements, or can also be arranged so as to be separated therefrom. The distance elements may also be constructed as an integrated component, for instance, in that the core has smaller dimensions than the shell and both the shell and the core are connected with the side elements.

According to a feature of the invention, the core is formed of textile material. In the case of such an embodiment of the piece of luggage, the core consists of a bag or bag-like structure, for example. By means of corresponding distance holders or constructive embodiments, respectively, it is prevented that the at least one piece of clothing, which is arranged on the inner side of the shell and which is to be protected against creasing, is subjected to a pressure. The distance holders must thus be embodied such that they prevent that a pressure can be exerted on the piece of clothing, starting at the bag.

Ideally, the holding elements for holding the at least one piece of clothing on the inner side of the shell of the piece of luggage are embodied by means of a garment bag. At least one clothes hanger, on which the at least one piece of clothing can be arranged optimally, can thereby be arranged in the garment bag.

The holding elements for holding the at least one piece of clothing on the inner side of the shell, however, can also be embodied only by means of tension belts, which hold the at least one piece of clothing on the inner side of the shell of the piece of luggage, which can be unfolded or unrolled.

At least in places on the inner side of the shell and or the inner side of the garment bag, respectively, a coating made of slip resistant material can be provided. A slipping and consequently a creasing of the piece of clothing can be prevented or at least considerably reduced by means of such a coating.

Shaped elements, which serve the purpose of protecting sensitive spots of the pieces of clothing can furthermore be arranged on the inner side of the shell of the piece of luggage and or the inner side of the garment bag, respectively. Such shaped elements are preferably formed of foam, so that the overall weight of the piece of the luggage is not increased considerably through this.

For more easily carrying the piece of luggage, at least one wheel, preferably at least two wheels, can be arranged on the shell or on the core. It goes without saying that four wheels can also be arranged on all corners of one side of the piece of luggage, whereby the maneuverability and handling can be improved further.

In particular in the case of the arrangement of two wheels on the piece of luggage, a pull-out bar is advantageous, so that the piece of luggage can be pulled comfortably in the slightly tilted state. Said pull-out bar can be arranged on the shell or on the core and serves for a comfortable transport of the piece of luggage.

The distance between shell and core can also be adjustable, so that the space for the storing of the at least one piece of clothing can be varied. The constructions can be embodied differently and can provide for a continuous adjustment or for an adjustment between two or a plurality stages. For example, one adjustment can be carried out by means of longitudinally adjusting the above-mentioned distance holders.

When a cover for the piece of luggage is provided, the latter can be protected against dirt and damages during transport. The cover is preferably embodied in the form of a bag comprising a closable opening, in which the piece of luggage can be arranged. Suitable materials can be textile fabrics or plastics.

When the outer dimensions of the shell of the piece of luggage in the closed state are maximally 55×40×20 cm, the piece of luggage can, according to the current International standard, be declared as hand luggage and can be taken along into the passenger cabin of an aircraft.

BRIEF DESCRIPTION OF THE DRAWINGS

The invention at hand will be defined in more detail by means of the enclosed drawings, which show different exemplary embodiments of pieces of luggage according to the invention.

FIGS. 11A-15B show different exemplary embodiments of pieces of luggage according to the invention in each case in the open state comprising an unrolled or unfolded shell.

DETAILED DESCRIPTION OF THE PREFERRED EMBODIMENTS

Figure 1:
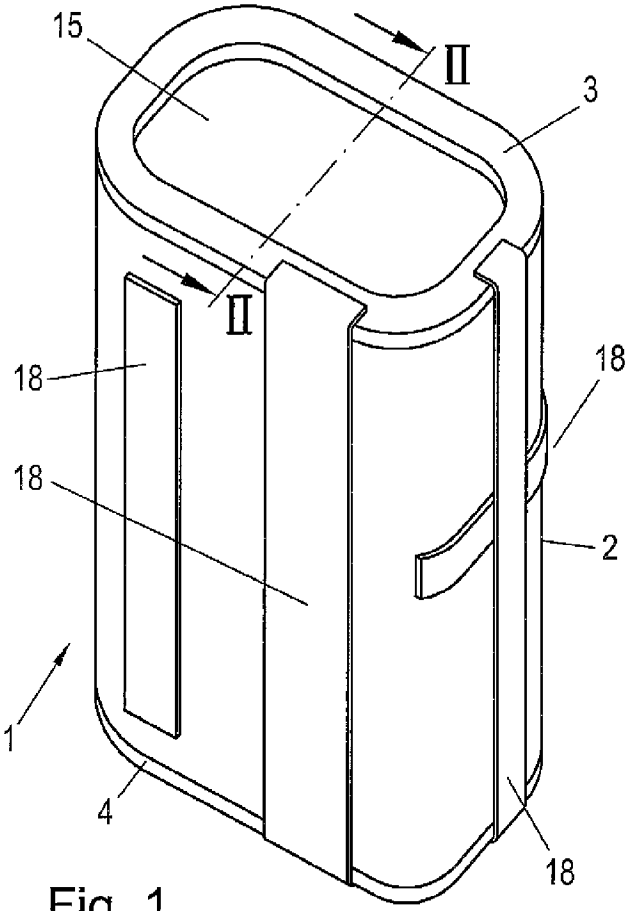
FIG. 1 shows a perspective view of a piece of luggage in the form of a suitcase in the closed state.

FIG. 1 shows an exemplary embodiment of a piece of luggage 1 according to the invention in the form of a suitcase in the closed state. The piece of luggage 1 consists of a shell 2 of at least partially rigid material and two side elements 3, 4. As in the case of known pieces of luggage 1, the shell 2 can be embodied differently, for example of rigid material (plastic or metal) or of flexible, in particular textile material, comprising corresponding reinforcing elements 18, which provide the shell 2 with the necessary stability. The reinforcing elements 18 can be arranged in longitudinal direction, transverse direction or also diagonally (not illustrated) on the piece of luggage 1 in different lengths and can also stabilize the shell 2 by the combination of different reinforcing elements 18 to form rigid structures. The reinforcing elements 18 are made of a material, which increases the stiffness of the remaining shell 2. For example, the reinforcing elements 18 can be made of plastic or light metal. Likewise, it is possible for the reinforcing elements 18 to be made of foam material, whereby the weight of the piece of luggage 1 can be reduced. A closable opening 15, via which the interior of the piece of luggage 1 can be accessed in an easy and comfortable manner, can be arranged in at least one side element 3, 4. The interior of the core 7 of the piece of luggage 1 according to the invention, which will be described further below, can be loaded or unloaded via such an opening 15, without having to unfold or unroll the shell 2 of the piece of luggage 1. The closable opening 15 can be formed for example by means of a zipper or the like, which is arranged accordingly on the side element 3 or 4.

Figure 2:
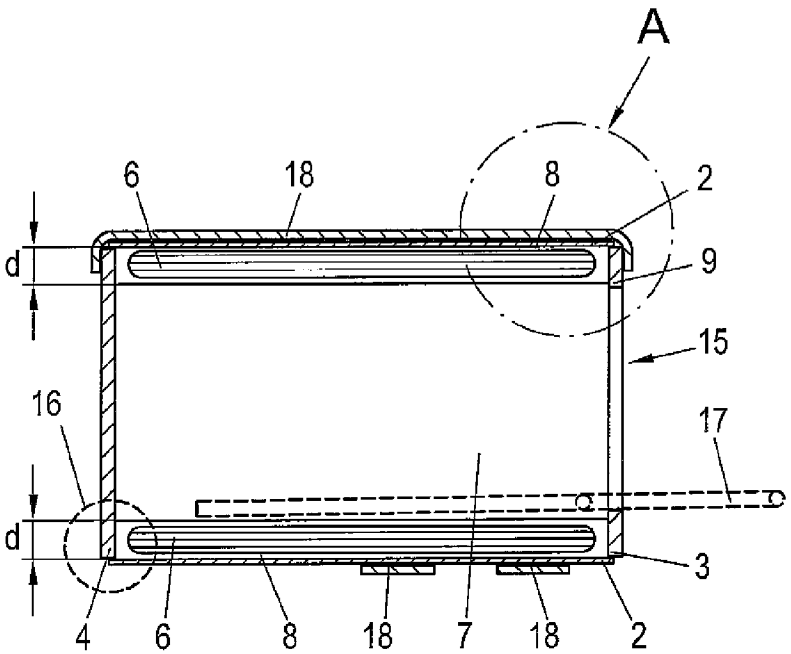
FIG. 2 shows a sectional view through the piece of luggage according to FIG. 1 along the sectional line II-II.
Figure 11B:
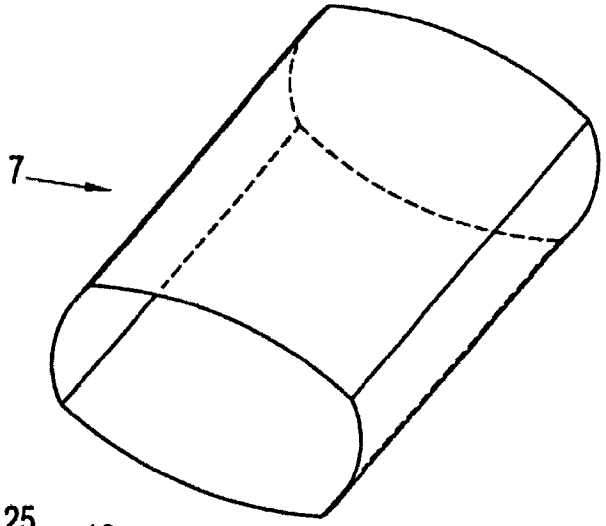

FIG. 2 shows a section through the piece of luggage 1 according to FIG. 1 along the sectional line II-II. Accordingly, the piece of luggage 1 encompasses a core 7, around which the shell 2 is arranged at a distance d. As is illustrated by means of the exemplary embodiments according to FIGS. 11-13, the shell 2 of the piece of luggage 1 is embodied so as to be capable of being unfolded or unrolled. In the closed state of the piece of luggage 1, at least one piece of clothing 6 can be stored in a substantially crease-free and pressure-free manner in the created space 8 between shell 2 and core 7. To ensure safety, on the inner side of the shell 2 corresponding holding elements 5 for holding the at least one piece of clothing 6 on the inner side of the shell 2 are provided (see FIGS. 11 to 15). The core 7 can be accessed via the closable opening 15, which has already been described above, in at least one side element 3 of the piece of luggage 1, and this space can also be loaded or unloaded, respectively, without unfolding or unrolling the shell 2. In the case of the embodiment of the piece of luggage 1 as suitcase or trolley, the arrangement of wheels 16, as suggested by a dotted line, is advantageous. The wheels 16 can be fastened to the shell 2 or to the core 7 or to the side element 4 of the piece of luggage 1, respectively. A pull-out bar 17, which can also be fastened to the shell 2 or to the core 7, also serves to more comfortably transport the piece of luggage 1. For ensuring the defined distance d between the core 7 and the shell 2, suitable distance elements 9 and/or appropriate measures are preferably provided.

Figure 3:
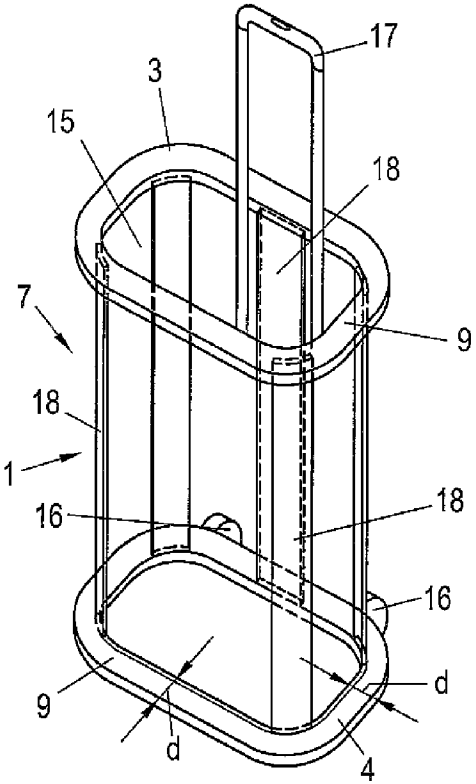
FIG. 3 shows an exemplary embodiment of the core when the shell of the piece of luggage according to FIG. 1 is removed.

FIG. 3 shows a perspective view onto an embodiment of the core 7 of a piece of luggage 1 with the shell 2 being removed. In the case of this alternative, the core 7 consists of a plurality of reinforcing elements 18, which are arranged in longitudinal direction and which are accordingly connected to the side elements 3, 4. The wheels 16 as well as the pull-out bar 17 are arranged on the core 7 in the case of this construction. By means of corresponding distance holders 9 on the side elements 3, 4, the distance d between core 7 and shell 2 (not illustrated) is ensured, which is essential for a substantially crease-free storing of the at least one piece of clothing 6 (not illustrated). In the case of the illustrated example, in the side element 3 an opening 15 is provided. In this case, the defined distance d is formed by the appropriately designed side elements 3, 4 which thus form appropriate distance elements 9.

FIGS. 4 to 10 show different embodiments of the connection between shell 2 and core 7 or side elements 3 or 4, respectively, according to detail A in FIG. 2 in enlarged view.

Figure 4:
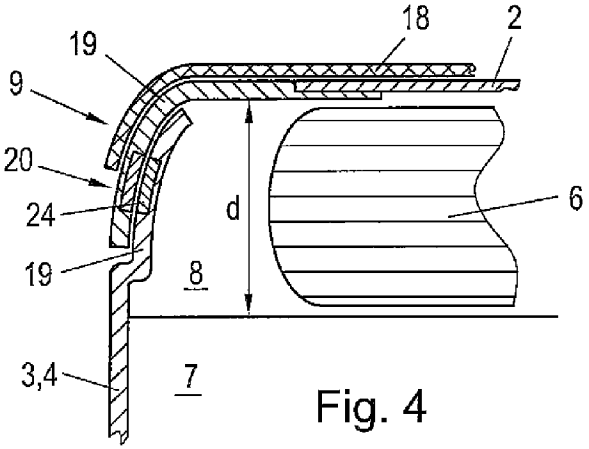
FIGS. 4-10 show details of different constructions of the connection between shell and core of a piece of luggage according to the invention in an enlarged illustration (detail A according to FIG. 2)

The shell 2 according to FIG. 4 can thereby be provided with corresponding reinforcing elements 18 or can be constructed of stiff elements. The shell 2 is detachably connected to the respective side element 3 or 4 via corresponding connecting devices 20 via connecting pieces 19 on the shell 2 and the respective side element 3 or 4, which can in each case also be embodied in one piece with the shell 2 or the side element 3 or 4. In the case of the illustrated embodiment, the connecting devices 20 are realized by means of magnets 24 in the two connecting pieces 19, said magnets 24 ensuring the connection between shell 2 and side elements 3 or 4 in the closed state of the piece of luggage 1. When the connecting pieces 19 are made of stiff material, they can simultaneously serve as distance holders 9, which ensure the distance d of the space 8 between core 7 and shell 2 of the piece of luggage 1 for the crease-free and pressure-free storing of the at least one piece of clothing 6. It is advantageous when the connecting pieces 19 are permanently connected to the reinforcing elements 18 and or when the reinforcing elements 18 are connected permanently among one another, respectively, and thus form a stable frame, which stabilizes and reinforces the shell 2 of the piece of luggage 1. The connections can be realized, for example by means of suitable rivets, adhesion or the like, or can be established by means of a one-piece formation of the parts, which are to be connected, to an integral hinge as connecting element.

Figure 5:
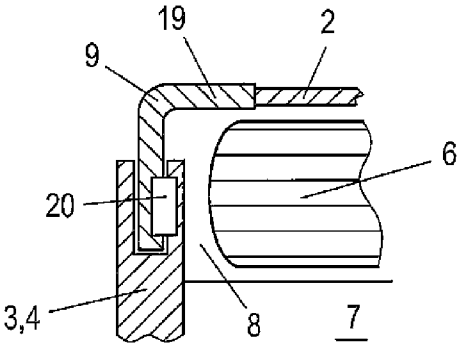

In the case of the alternative according to FIG. 5, the side element 3 or 4 is embodied with a groove, into which the connecting piece 19 or distance holder 9, respectively, which is connected to the shell 2, projects and which is detachably connected to the side element 3 or 4 via corresponding connecting devices 20. The connecting devices 20 can be formed by means of zippers, hook-and-loop fasteners, magnetic fasteners or the like.

Figure 6:
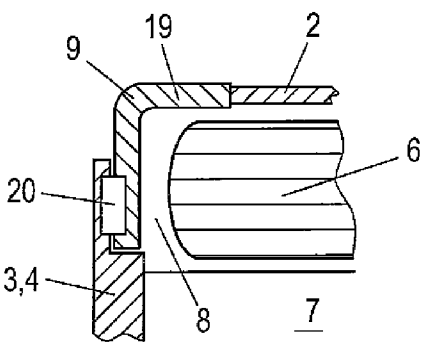

In the case of the alternative according to FIG. 6, a step is formed in the side element 3 or 4, into which the connecting piece 19 or distance holder 9, which is connected to the shell 2, projects, and which is connected to the side element 3 or 4 via corresponding connecting devices 20.

Figure 7:
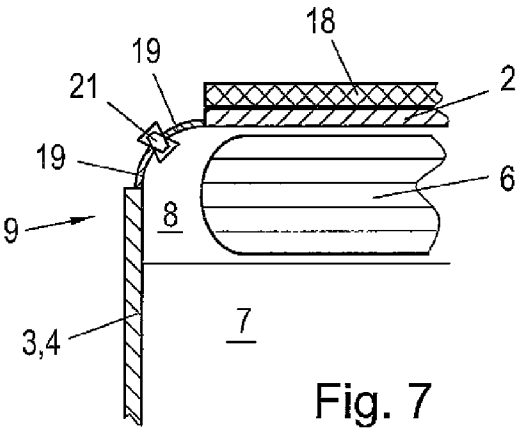

In the case of the alternative according to FIG. 7, the shell 2, which can be provided with reinforcing elements 18, is connected to the side element 3 or 4 via connecting pieces 19 and a zipper 21. The side elements 3, 4 thus form along with the connecting pieces 19 distance elements 9 for ensuring the defined distance d between the core 7 and the shell 2.

Figure 8:
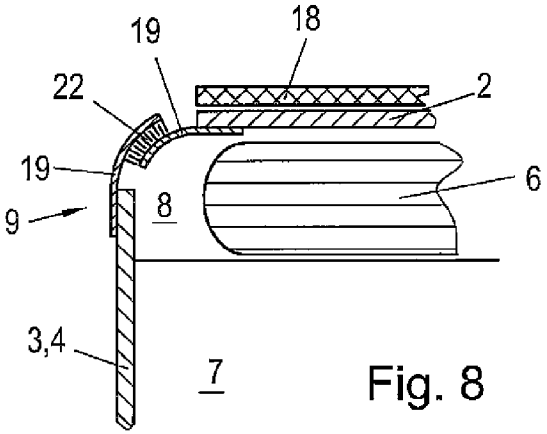

The alternative according to FIG. 8 provides for a connection of the shell 2 to the side element 3 or 4 in the form of a hook-and-loop fastener 22. The components of the hook-and-loop fastener 22 are in each case arranged on a connecting piece 19, which is connected to the shell 2 and the side element 3 or 4. In the case of the embodiments according to FIGS. 7 and 8, the connecting pieces 19 can also be formed of flexible material, e.g. textile material. In this case, on the shell 2 or on the core 7 corresponding distance holders 9 must be provided, which ensure the distance d between shell 2 and core 7 of the piece of luggage 1.

Figure 9:
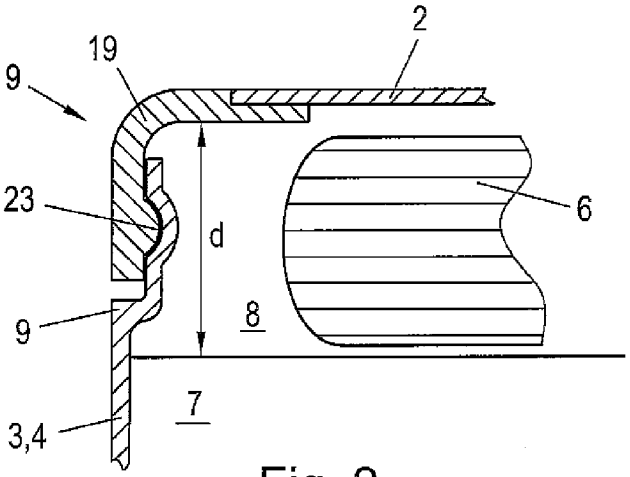

The alternative according to FIG. 9 provides for connecting pieces 19, which are embodied in the form of a snap connection 23. Due to the fact that the connecting pieces 19 are in this case formed of rigid material, they simultaneously represent the distance holders 9 between the shell 2 and the side element 3 or 4. In the closed state of the piece of luggage 1, the connecting pieces 19 snap into place accordingly in the area of the snap connection 23.

Figure 10:
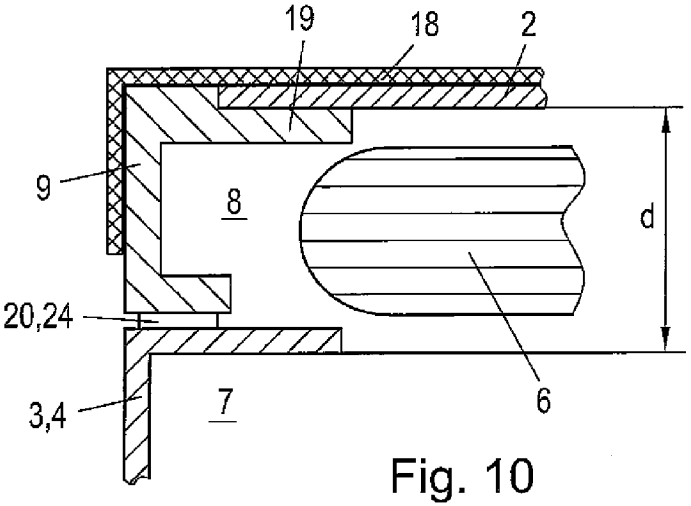

Finally, FIG. 10 shows a further embodiment of a connection between shell 2 and side element 3 or 4 of the piece of luggage 1. The side element 3 or 4 and the shell 2 is thereby in each case connected to or provided with, respectively, a corresponding connecting piece 19 representing the distance element 9. In the case of this alternative, the side element 3 or 4 and the connecting piece 19 can be produced in a simple and cost-efficient manner in an injection molding process and the connecting device 20 can be integrated in the form of an integral hinge, for example. It goes without saying that the connecting device can also be embodied in a different manner or can be formed by means of magnets 24.

It is essential in the case of all alternatives of the connection between shell 2 and side element 3 or 4 that, on the one hand, it can be disengaged as easily as possible, intuitively and without tools and that, on the other hand, the piece of luggage 1 is held as securely as possible in the closed state.

Figure 11A:
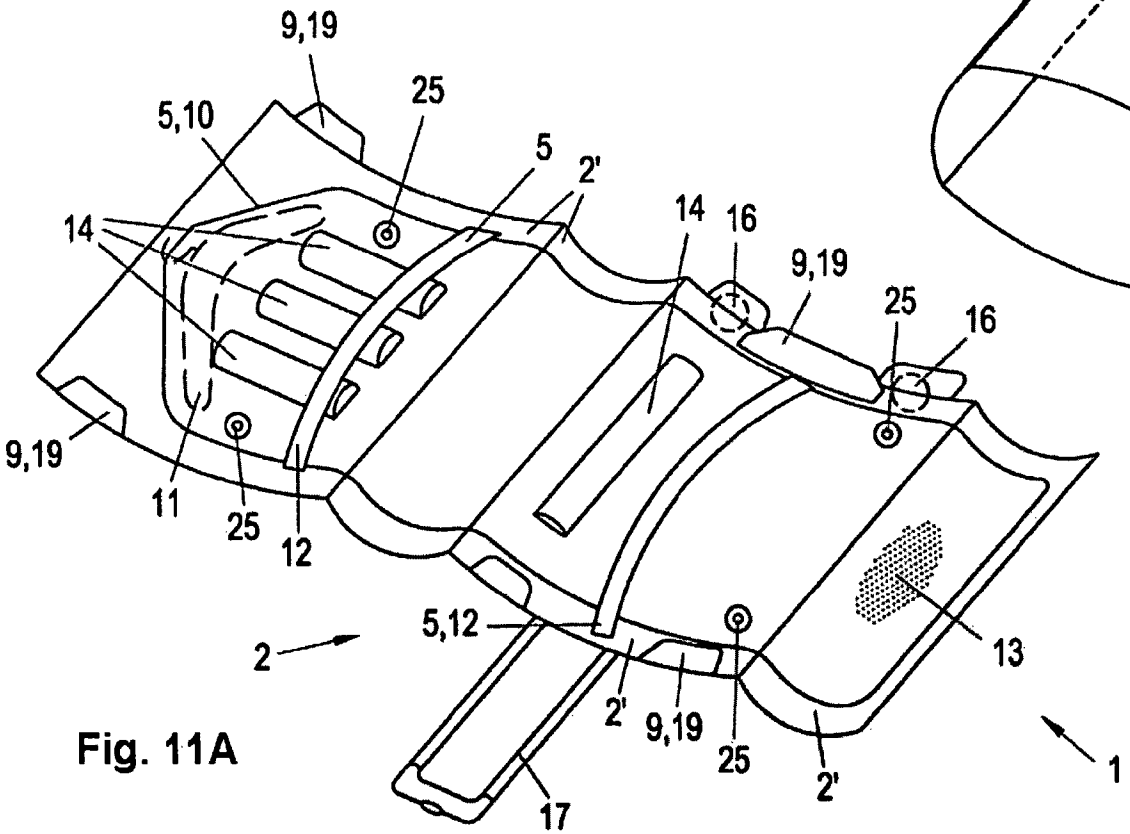

FIG. 11A shows an exemplary embodiment of the piece of luggage 1 in the open state. Accordingly, the shell 2 of the piece of luggage 1, which consists of a plurality of elements 2', which are connected to one another in an articulated manner, is unfolded or unrolled, respectively. The elements 2' can consist of flexible material comprising corresponding reinforcing elements 18 (see FIG. 1) or also of rigid material. The ends or edges of the shell 2, respectively, which touch one another in the closed state of the piece of luggage 1, can be connected to one another, preferably so as to be capable of being locked (not illustrated). For connection to the side elements 3, 4 and the core 7 shown in FIG. 11B, corresponding connecting pieces 19 are provided, which can simultaneously serve as distance holders 9.

In the case of this exemplary embodiment of the piece of luggage 1, the wheels 16 and the pull-out bars 17 are connected to the shell 2. It is ensured through this that the shell 2 in the closed state of the piece of luggage 1 is arranged at a distance d around the core 7 and a space 8 is thus formed, in which at least one piece of clothing 6 can be stored in a substantially crease-free manner. For holding the at least one piece of clothing 6 on the inner side of the shell 2, holding elements 5, which can be embodied differently, are arranged on the inner side. It is essential that the at least one piece of clothing 6 is held on the inner side of the shell 2 by means of the holding elements 5. For example according to FIG. 11A, the holding elements 5 are formed by means of a garment bag 10, which can be fastened to the inner side of the shell 2. In the closed state of the shell 2, the piece of clothing 6 is folded with relatively large radii, whereby creases cannot be created. On principle, an embodiment alternative, in the case of which the garment bag 10 is fixedly arranged on the inner side of the shell 2 and is connected thereto, is also possible. Preferably, at least one clothes hanger 11, on which the pieces of clothing 6 can be arranged in the usual manner, is included in the garment bag 10. For fastening the garment bag 10 to the inner side of the shell 2, corresponding connecting elements 25 can be provided. The connecting elements 25 can be formed by means of snaps, magnets or the like. Instead of a garment bag 10 or in addition thereto, further holding elements 5 in the form of tension belts 12 can be provided, by means of which the pieces of clothing 6 can be held directly on the inner side of the shell 2 or by means of which the garment bag 10 can be fixed to the inner side of the shell 2. A coating 13 of slip resistant material, which makes a slipping of the pieces of clothing 6, which are to be stored, more difficult or which reduces it considerably, respectively, can be arranged on the inner side of the shell 2 or individual elements 2' of the shell 2, respectively. To support the crease-free storing of the pieces of clothing 6 on the inner side of the shell 2, shaped elements 14 can be placed at suitable locations. The shaped elements 14 are preferably made of foam.

Figures 12A, 12B:
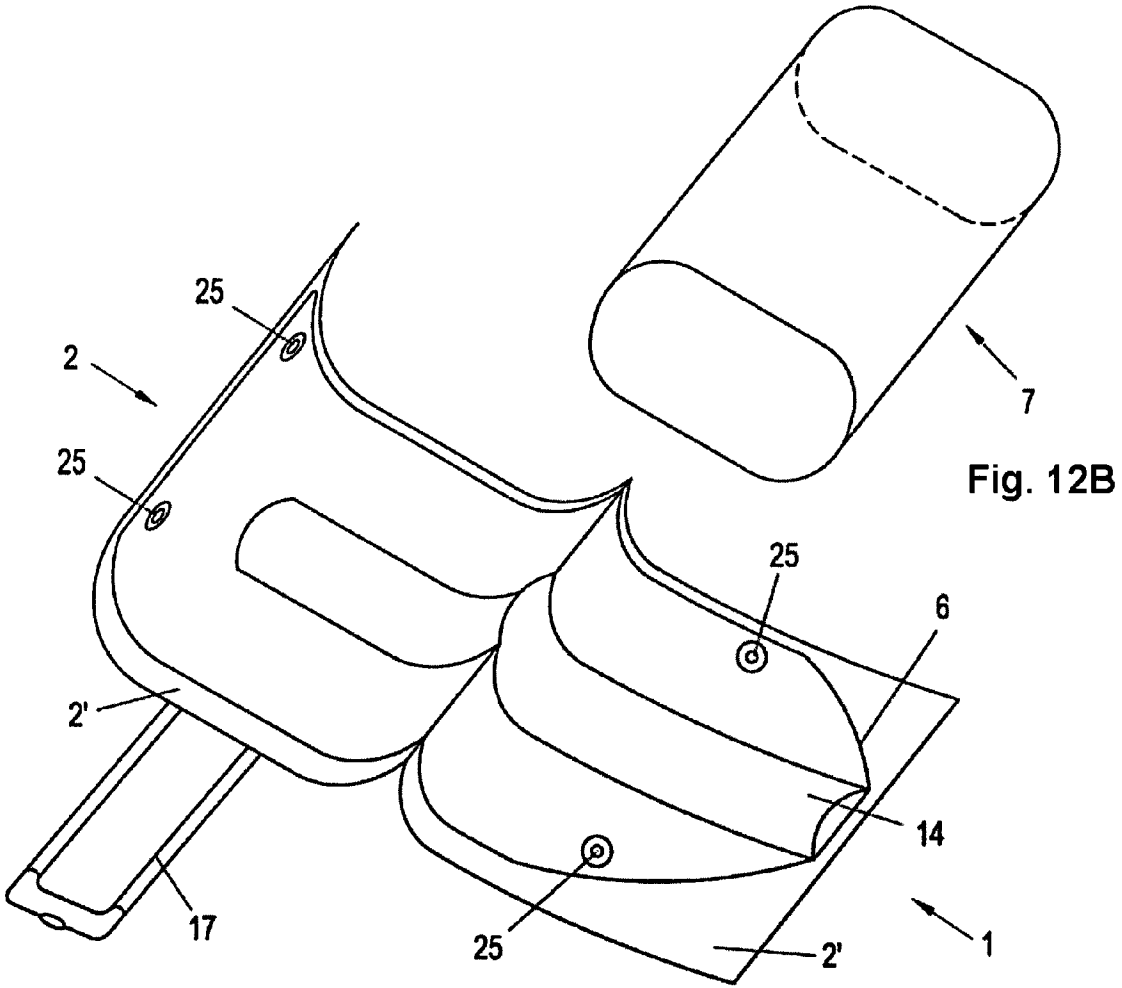

The exemplary embodiment illustrated in FIG. 12A shows a shell 2, consisting of two elements 2' of at least partially rigid material, which are unfolded accordingly in the open state. Connecting elements 25, via which a garment bag 10 (not illustrated) can be fastened, for example, are arranged on the inner side of the shell 2. Corresponding shaped elements 14 can be provided to support the crease-free storing of the at least one piece of clothing 6 (not illustrated). The shell 2 is arranged around the core 7 (shown in FIG. 12B) such that a space between the shell 2 and the core 7, in which the transported piece of clothing 6 can be transported in a protected manner, is formed by means of corresponding distance holders 9 (not illustrated). Further objects can be stored in the interior of the core 7.

Figure 13:
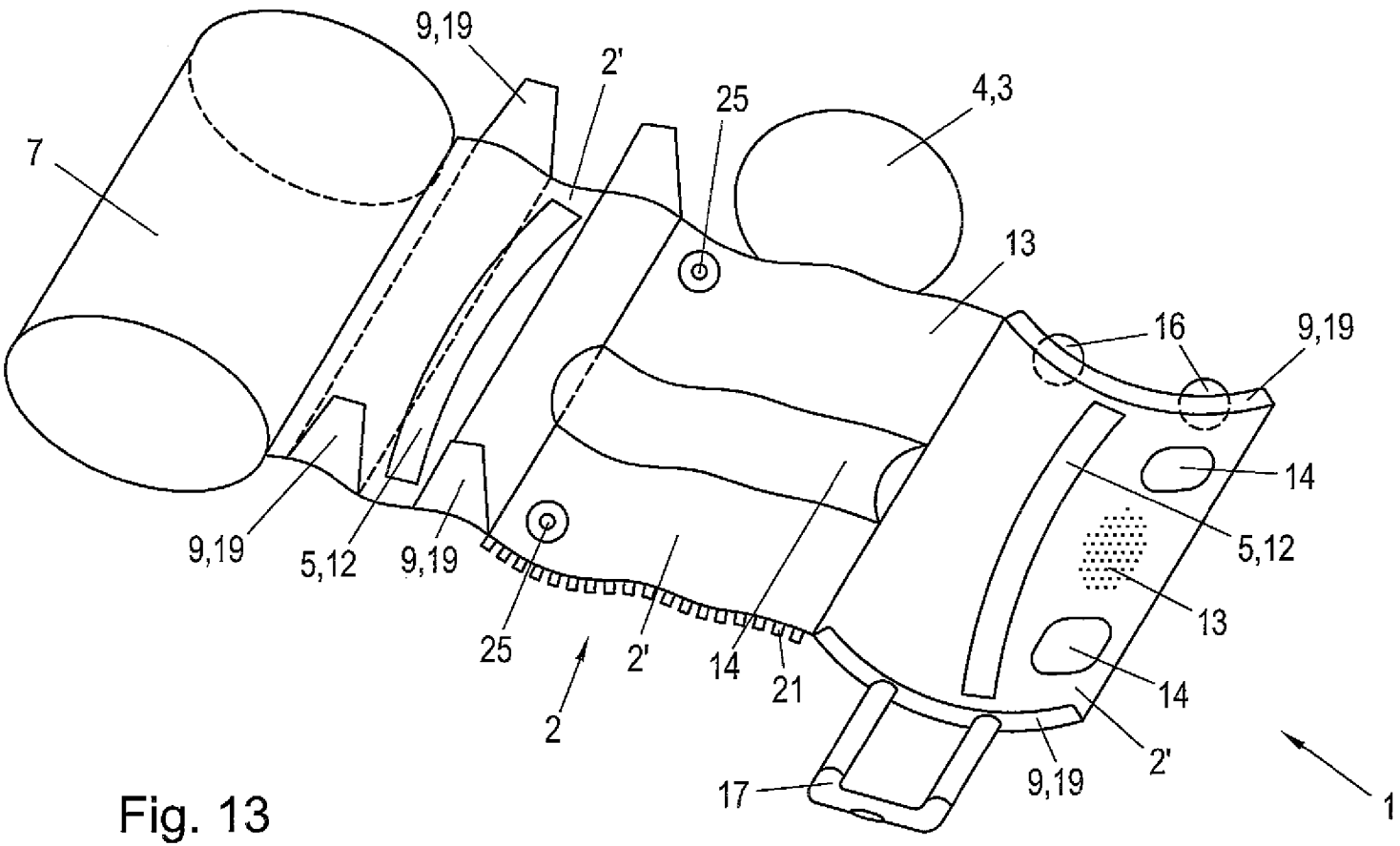

In the case of the alternative according to FIG. 13, the shell 2 of the piece of clothing 1 can at least partially be formed of flexible material, so that it can be unrolled for opening the piece of luggage 1. In the case of this exemplary embodiment, the shell 2 is permanently connected to at least one side element 3 or 4. For connection to the other side element 3 or 4 or to the core 7, in turn corresponding connecting pieces 19 are provided, which simultaneously serve as distance holders 9. The shell 2 is furthermore permanently connected to the core 7 at one end. Such an alternative can be produced in a common injection molding process, for example, wherein the connections between core 7 and shell 2 and the elements 2' of the shell 2 among one another can be formed by means of hinge-like elements, in particular integral hinges having a smaller material thickness (see FIG. 14). The distance holders 9 ensure the distance d between core 7 and shell 2, when this shell 2 is placed around the core 7 for closing the piece of luggage 1. Zippers 21 for connection to a side element 3 or 4 can be also provided. Holding elements 5 in the form of tension belts 12 serve to hold the at least one piece of clothing 6 (not illustrated). Coatings 13 of slip resistant material and shaped elements 14 can again be arranged at suitable locations on the inner side of the shell 2. In the case of this alternative of the piece of luggage 1, the wheels 16 and the pull-out bars 17 are also connected to the shell 2, but they can also be fastened to the core 7.

Figure 14:
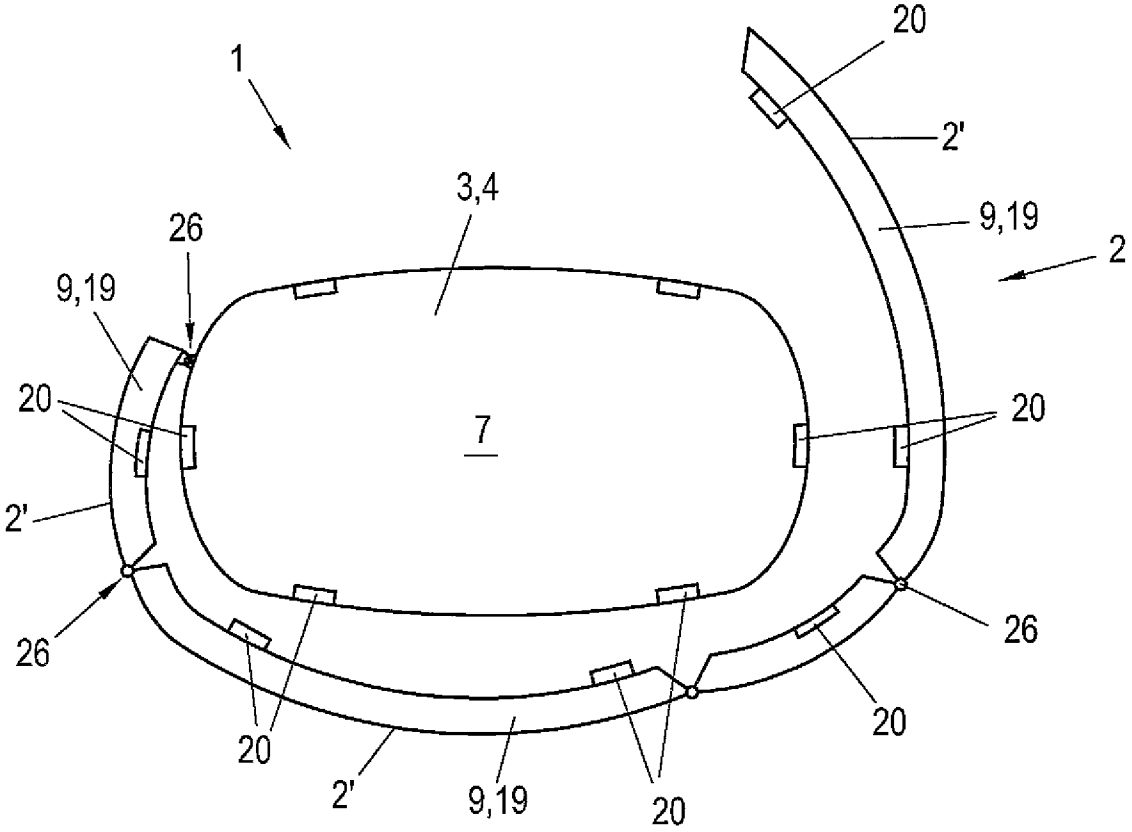

FIG. 14 shows a schematic view onto an alternative of the piece of luggage 1, in the case of which the core 7 and the shell 2 are connected to one another via hinge-like elements 26, in particular integral hinges. The individual elements 2' of the shell 2 among one another and the connecting pieces 19, which also represent the distance elements 9, comprising the elements 2' or also among one another are preferably connected to one another via such hinge-like elements 26. Such an embodiment of a piece of luggage can be produced in a particularly cost-efficient manner. In the illustrated alternative, the side elements 3 and 4 are connected to the core 7. To connect the shell 2 or the elements 2' thereof, respectively, or the connecting pieces 19 to the core 7 in the closed state of the piece of luggage 1, corresponding connecting devices 20, for example zippers, hook-and-loop fasteners, magnetic fasteners or the like are provided.

Figures 15A, 15B:
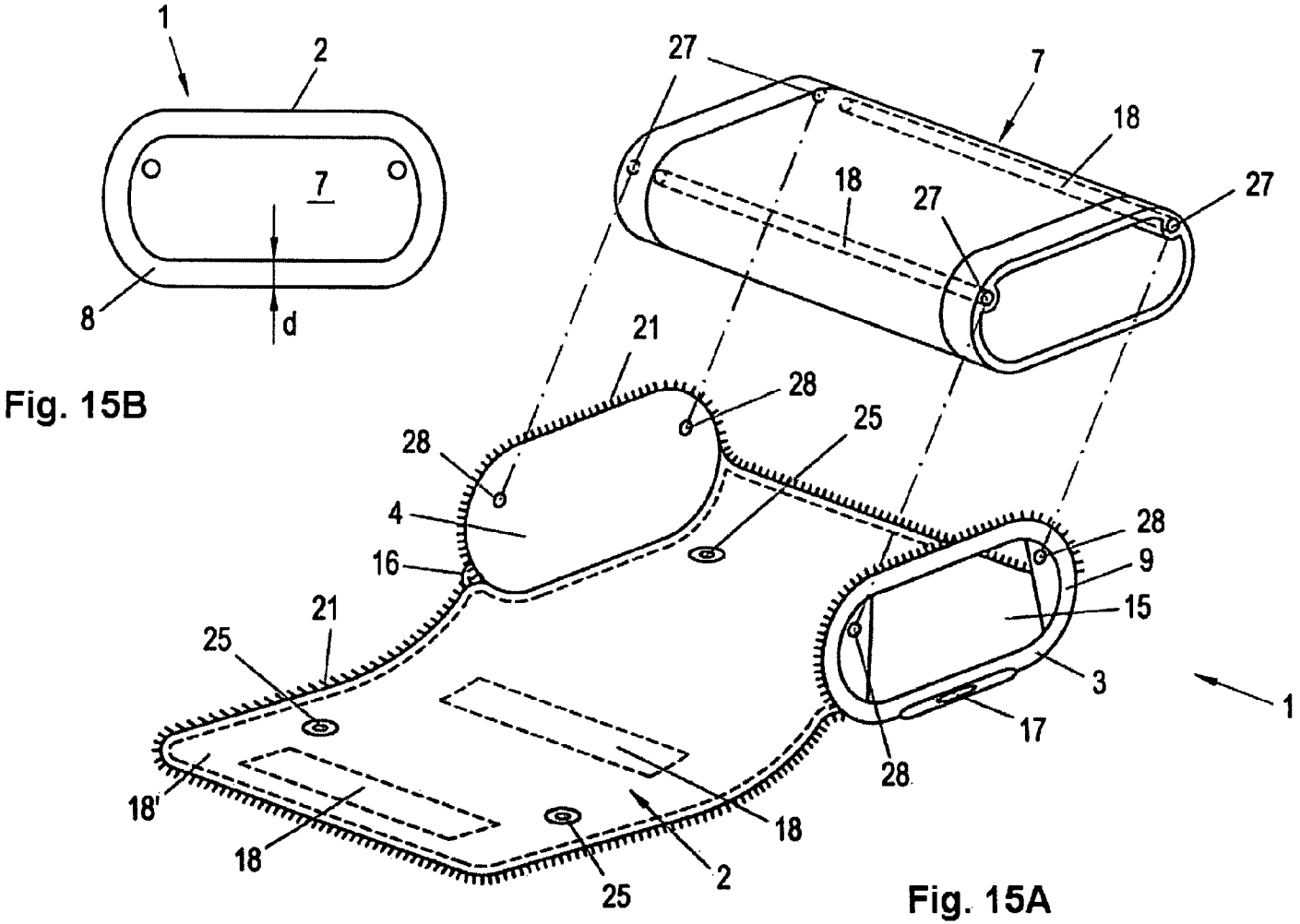

Finally, FIG. 15A shows a preferred embodiment of the piece of luggage 1, in the case of which the shell 2 consists of flexible material, in particular textile material, and is preferably made in one piece with the side elements 3 and 4. A corresponding stiffness is provided to the shell 2 via corresponding reinforcing elements 18, which can consist of foam material, for example, but also of harder materials, so as to avoid that a too-high pressure is exerted on the pieces of clothing in the interior of the piece of luggage 1 from the outside. A reinforcing element 18', which extends across the entire shell 2 to a large extent can also be provided. It is also possible to produce the entire shell 2, including side elements 3, 4 of foam-containing material, so that the piece of luggage 1 retains the required stability, but is still deformable, so as to provide for an unfolding or unrolling of the shell 2. On the inner side of the shell 2 corresponding connecting elements 25 for fastening a garment bag or the like (not illustrated) can again be provided. The connecting elements 25 can be formed by means of snaps, magnets or the like. The garment bag or the like (not illustrated) can also be fixedly connected to the inner side of the shell 2 or can be integrated in the shell 2. The side elements 3, 4 are reinforced by means of corresponding frames or the like. In the illustrated exemplary embodiment, the core 7 of the piece of luggage 1 is formed by means of a flexible material, which is reinforced by means of corresponding reinforcing elements 18. Fixing elements 27, which fit into corresponding counter pieces 28 in the side elements 3, 4, are arranged on the sides of the core 7, which face the side elements 3, 4. The fixing elements 27 and corresponding counter pieces 28 can be embodied differently (for example in the form of snaps, magnets or snap connections) and ensure that the core 7 is positioned at a distance d from the inner side of the shell 2 of the piece of luggage 1, as is illustrated in the schematic sectional view of the closed piece of luggage 1 in FIG. 15B. In this case, the defined distance d between the core 7 and the shell 2 or the distance elements 9, respectively, is implemented by the appropriate arrangement of the core 7 at the side elements 3, 4 and along with the appropriate design of the side elements 3, 4 and the fixing of the shell 2 at the side elements 3, 4.

In the closed state of the piece of luggage 1, the ends of the shell 2, which touch one another, and the shell 2 are connected to the side elements 3 and 4, preferably via a zipper. The embodiment alternative of the piece of luggage 1, which is illustrated in FIG. 15, is characterized by a particularly simple and cost-efficient producibility and low dead weight.

The piece of luggage 1 according to the present invention can be produced in a variety of forms and from of most different materials, like common suitcases or bags.

The invention claimed is:

1. A piece of luggage, in particular a suitcase, comprising a shell of at least partially rigid material and side elements, wherein the shell is embodied so as be capable of being unfolded or unrolled and is provided on an inner side with holding elements, which holding elements are formed by at least one of a garment bag and tension belts and are equipped to hold at least one piece of clothing on the inner side of the shell, wherein the shell is arranged at a defined distance around a core in a closed state of the piece of luggage, wherein the at least one piece of clothing is stored in a substantially crease-free and pressure-free manner within the space formed by the defined distance between core and shell, wherein in the closed state of the piece of luggage, the side elements are connected to at least one of the shell and the core, respectively, so as to be capable of being disengaged, wherein at least one wheel is arranged on the shell or on the core, wherein a pull-out bar is arranged on the shell or on the core, and wherein at least one side element of the side elements encompasses a closable opening, through which an interior of the core is accessed without having to unfold or unroll the shell of the piece of luggage.

2. The piece of luggage according to claim 1, wherein the shell of the piece of luggage comprises a plurality of ends which touch one another in the closed state and are connected to one another. preferably so as to be capable of being locked.

3. The piece of luggage according to claim 1, wherein at least one of the shell and the core, respectively, is formed of elements of substantially rigid material, which are connected to one another in an articulated manner.

4. The piece of luggage according to claim 1, wherein at least one of the shell and the core, respectively, is formed of flexible material comprising reinforcing elements.

5. The piece of luggage according to claim 1, wherein at least one of the shell, the core respectively, and the side elements, respectively, encompasses connecting pieces for connecting at least one of the shell and the core, respectively, to the side elements.

6. The piece of luggage according to claim 5, wherein the side elements are connected to at least one connecting piece and, at best, connecting pieces are connected among one another via hinge-like elements.

7. The piece of luggage according to claim 5, further comprising a plurality of reinforcing elements, wherein the reinforcing elements are permanently connected to at least one of one another and the connecting pieces, respectively, for stabilizing the shell.

8. The piece of luggage according to claim 1, wherein on the core fixing elements are provided and on the side elements counter pieces to the fixing elements are provided.

9. The piece of luggage according to claim 1, wherein at least one side element is fixedly connected to at least one of the shell and the core, respectively.

10. The piece of luggage according to claim 1, wherein at least one of the core, the shell and the side elements, respectively, includes distance holders for ensuring the distance between the core and the shell.

11. The piece of luggage according to claim 1, wherein on places on at least one of the inner side of the shell and of a garment bag, respectively, a coating of slip resistance material is provided.

12. The piece of luggage according to claim 1, wherein shaped elements are arranged on at least one of the inner side of the shell and of a garment bag, respectively.

13. The piece of luggage according to claim 1, wherein the distance between the shell and the core is adjustable.

* * * * *